US010932506B2

(12) United States Patent
Zeng

(10) Patent No.: US 10,932,506 B2
(45) Date of Patent: Mar. 2, 2021

(54) GLOVE WITH A LOCKED AND SUPPORTED CUFF

(71) Applicant: CORE PACIFIC, LLC, Houston, TX (US)

(72) Inventor: Qing Hai Zeng, Houston, TX (US)

(73) Assignee: CORE PACIFIC LLC, Houston, TX (US)

( * ) Notice: Subject to any disclaimer, the term of this patent is extended or adjusted under 35 U.S.C. 154(b) by 0 days.

(21) Appl. No.: 16/287,215

(22) Filed: Feb. 27, 2019

(65) Prior Publication Data

US 2020/0268078 A1 Aug. 27, 2020

(51) Int. Cl.
*A41D 19/00* (2006.01)

(52) U.S. Cl.
CPC ..... *A41D 19/0048* (2013.01); *A41D 19/0058* (2013.01); *A41D 19/0089* (2013.01)

(58) Field of Classification Search
CPC ..... A41D 19/0048; A41D 19/0058; A41D 19/0089; A41D 19/0044; A41D 19/0055; A41D 19/0062; A41D 19/00
See application file for complete search history.

(56) References Cited

U.S. PATENT DOCUMENTS 2,117,417 A * 5/1938 Hall ..... A41D 19/0062 2/168
2,229,837 A * 1/1941 Claffy ..... A41D 19/0055 2/168
2,299,855 A * 10/1942 Smith ..... H02G 1/02 2/168
2,813,272 A * 11/1957 Hagan ..... A41D 19/0089 285/260
3,009,164 A * 11/1961 Frey ..... A41D 19/0055 2/270
3,099,015 A * 7/1963 Renehan ..... B25J 21/02 285/260
3,555,564 A * 1/1971 Miskell et al. .... A41D 19/0062 2/168
5,442,816 A * 8/1995 Seketa ..... A61B 42/10 2/161.7
5,682,612 A * 11/1997 Schwarz ..... A41D 19/0055 2/161.6

(Continued)

FOREIGN PATENT DOCUMENTS

WO 1992 012649 A1 8/1992

*Primary Examiner* — Heather Mangine
(74) *Attorney, Agent, or Firm* — Craft Chu PLLC; Andrew W. Chu

(57) ABSTRACT

The glove includes a hand portion, a sleeve portion integral to the hand portion and extending conically outward, a cuff portion integral with the sleeve portion and extending conically outward, and a connection portion between the cuff portion and the sleeve portion. The cuff portion has an extended configuration and folded configuration. The connection portion includes an annular band includes a first ring, a second ring, and a protruding ring between the first and second rings. The protruding ring includes a first bulged rim, a second bulged rim, and a band portion between the first and second bulged rims. The connection portion is in a first hinged relationship with the sleeve portion at the first ring so as to lock the folded configuration, and a second hinged relationship of the connection portion with the cuff portion supports the folded configuration.

9 Claims, 5 Drawing Sheets

(56) References Cited

U.S. PATENT DOCUMENTS

| | | | | |
|---|---|---|---|---|
| 5,953,756 | A * | 9/1999 | Vrissimdjis | A41D 19/0082 2/16 |
| 6,249,917 | B1 * | 6/2001 | Vrissimdjis | A41D 19/0058 2/161.6 |
| 7,480,945 | B2 | 1/2009 | Knuth et al. | |
| 8,146,174 | B2 | 4/2012 | Knuth et al. | |
| 9,867,672 | B2 | 1/2018 | Zeng | |
| 2006/0195965 | A1 * | 9/2006 | Knuth | A41D 19/0062 2/159 |
| 2008/0092261 | A1 * | 4/2008 | Yu | A41D 19/0089 2/16 |
| 2009/0077701 | A1 * | 3/2009 | Holley | A41D 19/0082 2/16 |
| 2009/0126075 | A1 | 5/2009 | Knuth et al. | |
| 2015/0282540 | A1 * | 10/2015 | Zeng | A41D 19/0089 2/168 |

* cited by examiner

GLOVE WITH A LOCKED AND SUPPORTED CUFF

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a glove. More particularly, the present invention relates to rubber or latex glove with a cuff. Even more particularly, the present invention relates to a rubber glove with an annular band to fold over a locked and supported cuff.

2. Description of Related Art Including Information Disclosed Under 37 CFR 1.97 and 37 CFR 1.98

Rubber gloves are commonly used for washing dishes and other household chores to protect the wearer from chemicals in cleaning products. The gloves also protect the wearer from water and wetness, which can damage skin and be uncomfortable. The protective rubber gloves can also insulate from the temperature of the water and prevent exposure to bacteria and germs in the water. There are also medical and foodservice applications of rubber gloves. Typically, latex is the type of rubber used to form the gloves, although other materials, such as PVC and neoprene, can be used.

The technology of gloves has developed. The aesthetic appearance of the glove can be modified in color and pattern. The thickness and weight of the rubber can also change. Particular elements are also added to gloves to affect functionality. The hand portion of the glove can be textured for improved grip. A liner can be inserted to prevent allergic reaction to latex. A cuff can be added to seal against the arm of the wearer. The cuff can have structure and texture for comfort and for preventing liquid from dripping into the glove.

Various patents have been granted in the field of glove with a cuff. U.S. Pat. No. 8,146,174, issued on Apr. 3, 2012 to Knuth et al, discloses a glove with an obstruction on the arm covering portion to trap liquid and prevent contact with the wearer. There are three segments with a fold over to form the cuff. U. S. Pat. No. 7,480,945, issued on Jan. 27, 2009 also to Knuth et al, discloses a glove with another version of an obstruction on the arm covering portion. A U-shaped indentation separates a flared end to fold over the indentation. U.S. Pat. No. 6,249,917, issued on Jun. 26, 2001 to Vrissimdjis et al, teaches another glove with a cuff. A thinned wall portion between the hand covering portion and the arm covering portion has a smaller thickness so that the end of the arm covering portion folds over to form the cuff. Annular beads can hold the fold, maintaining structure of the cuff. U. S. Pat. No. 5,953,756, issued on Sep. 21, 1999 also to Vrissimdjis et al, describes another cuff on a glove formed by an undulation and a thickened wall portion.

The prior art systems of gloves with a cuff are difficult and expensive to manufacture. Creating the beads, bulges and undulations require specialized machining and extra steps by nature of latex construction. Pouring latex over a mold does not easily create cuffing structures of the prior art systems. In the patents by Vrissimdjis, the annular beads and thickened wall portions require an extra step of setting an annular ring to cause the latex to pool at the specific location (the '756 patent). There must also be a wall portion to weaken the structure of the glove. The wall portion allows the fold at the structurally weaker portion of the glove. There could also be an extra step of dipping another layer of latex to coat the annular bead (the '917 patent). Similarly, the patents by Knuth rely on the same theory of construction of latex build-up to create the U-shape and pivot points in latex. Other disclosures in the prior art would require special machines to cast a glove with a pre-formed cuff, such as FIGS. 6 and 6A of the '945 patent, in order for the cuff to maintain its position relative to the glove.

U.S. Pat. No. 9,867,672, issued to the present inventor on 16 Jan. 2018, discloses a rubber glove with preset pivot to fold over a locked cuff. In this disclosure, an annular ridge of a connection portion had V-shaped channels on each side of the annular ridge so as to determine the preset pivot. Each V-shaped channel reduced the thickness of the glove between the sleeve portion and the annular ridge and between the sleeve portion and the cuff portion. The bottom of the V was the thinnest thickness of the glove material. With less material at the bottom of the V, this thinnest thickness allowed the cuff portion to pivot or hinge at the connection portion. The manufacture of gloves prevents sharp angles and hard edges. When a glove is formed by dipping a mold in a glove material (rubber, latex, etc.) and allowing gravity to distribute the glove material along the mold to into the glove shape, The V-shape was approximate. U.S. Pat. No. 9,867,672 acknowledged this limitation by defining the scope of the claims as "generally rectangular" and "generally orthogonal". There is a need to be more precise and accurate in the description of the glove with a cuff to account for the real-life constraints of glove manufacture.

It is an object of the present invention to provide an embodiment of a glove with a locked and supported cuff.

It is an object of the present invention to provide an accurate embodiment of a glove with a locked and supported cuff, according to features formed in the manufacturing process.

It is an object of the present invention to provide a precise embodiment of a glove with a locked and supported cuff, according to features formed in the manufacturing process.

It is another object of the present invention to provide an embodiment of a glove having a connection portion with an annular band for locking and supporting the cuff portion in a folded position.

It is still another object of the present invention to provide an embodiment of a glove having an annular band being comprised of a first ring being adjacent the sleeve portion, a second ring, and a protruding ring between the first ring and the second ring.

It is still another object of the present invention to provide an embodiment of the protruding ring of the annular band having a first bulged rim adjacent the first ring, a second bulged rim adjacent the second ring, and a band portion between the first bulged rim and the second bulged rim.

It is an object of the present invention to provide an embodiment of a glove with a cuff folded over a first ring of the annular band.

It is an object of the present invention to provide an embodiment of a glove with an annular band and an additional annular band.

It is an object of the present invention to provide an embodiment of a glove with a cuff folded over an additional first ring of the additional annular band.

It is an object of the present invention to provide an embodiment of a glove by a dipping process without flow disruption of the latex.

It is another object of the present invention to provide an embodiment of a glove by a dipping process with a groove and smooth flow.

These and other objectives and advantages of the present invention will become apparent from a reading of the attached specifications and appended claims.

BRIEF SUMMARY OF THE INVENTION

Embodiments of the present invention include a glove comprising a hand portion, a sleeve portion, a cuff portion, and a connection portion. The sleeve portion is made integral to the hand portion and extends conically outward from the hand portion. The sleeve portion has a sleeve thickness formed by the conventional manufacturing process of the glove. The cuff portion 16 is made integral with the sleeve portion and extends conically outward from the sleeve portion. The cuff portion has a cuff thickness also formed by the conventional manufacturing process. The cuff portion can have an extended configuration with the hand portion, the sleeve portion, and the cuff portion in linear alignment and a folded configuration with the hand portion and the sleeve portion in linear alignment and the cuff portion bent over the sleeve portion toward the hand portion. The cuff portion is folded over the sleeve portion at the connection portion.

Embodiments of the present invention include the connection portion being between the cuff portion and the sleeve portion, and the connection portion is comprised of an annular band. The connection portion of this invention locks and supports the cuff portion in the folded configuration. Locking refers to resisting unfolding of the cuff portion. Supporting refers to increasing the resisting unfolding.

The annular band can comprise a first ring adjacent to the sleeve portion, a second ring, and a protruding ring between the first ring and the second ring. The protruding ring can comprise a first bulged rim, a second bulged rim, and a band portion with a band thickness. The relationships between the components relates to the relative thickness of the components. The first bulged thickness is greater than the sleeve thickness and greater than the band thickness, and the second bulged thickness greater than the cuff thickness and greater than the band thickness. The band thickness is greater than the sleeve thickness and greater than the cuff thickness.

Embodiments of the present invention include the connection portion being in a first hinged relationship with the sleeve portion at the first ring. The protruding ring is folded over the sleeve portion, when the cuff portion is in the folded configuration. The first bulged rim and the second bulged rim can contact the sleeve portion when the cuff portion is in the folded configuration so as to lock folded configuration. The connection portion is in a second hinged relationship with the cuff portion at the second ring so as to support folded configuration. The weight of the cuff portion exerted against the first hinged relationship is reduced by this second hinged relationship. The present invention locks and supports the folded configuration of the cuff portion.

In some embodiments, there is an additional annular band, and a transitional portion between the annular band and the additional annular band. The additional annular band has analogous components to the annular band, such as an additional first ring, an additional second ring, and an additional protruding ring. The additional protruding ring is analogous to the protruding ring with an additional first bulged rim, an additional second bulged rim, and an additional band portion. The additional annular band is not mere repetition of an existing part because there is a new relationship to the transition portion and because there are new relationships, in particular the hinged relationships between the components with different thickness to achieve locking and supporting unlike the prior art.

The additional annular band can be adjacent to the cuff portion, so the locking and supporting is achieved by different hinged relationships at either the first ring of the annular band or an additional first ring of the additional annular band. When the first hinged relationship at the first ring determines the folded configuration, the first bulged rim and the second bulged rim lock the folded configuration, and the second hinged relationship at the second ring, a first additional hinged relationship at the additional first ring, and an additional second hinged relationship at the additional second ring support the folded configuration. When the first additional hinged relationship at the additional first ring determines the folded configuration, the additional first bulged rim and the additional second bulged rim lock the folded configuration, and the additional second hinged relationship at the additional second ring support the folded configuration.

DETAILED DESCRIPTION OF THE INVENTION

Figure 5A:
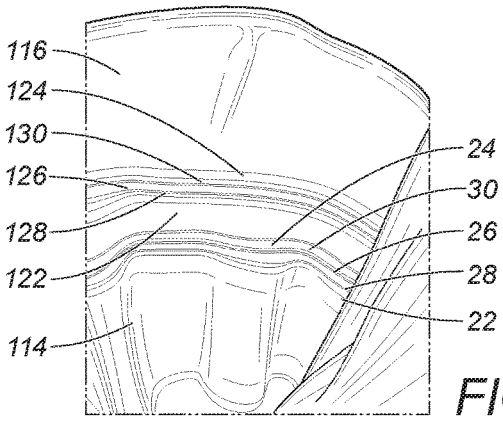
FIGS. 5A, 5B, 5C are photo illustrations of the relative thicknesses of embodiments of the glove at the sleeve portion, the first ring of the annular band, protruding ring of the annular band, the second ring of the annular band, and the cuff portion.
Figure 5B:
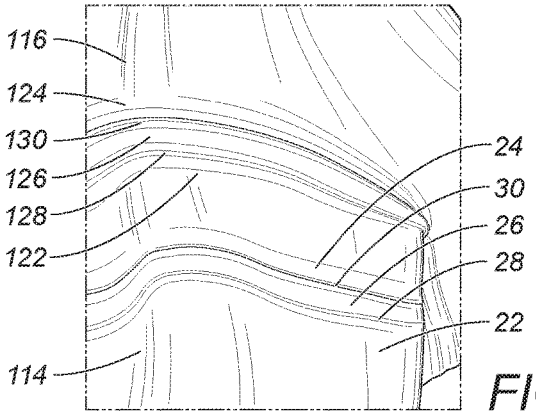
Figure 5C:
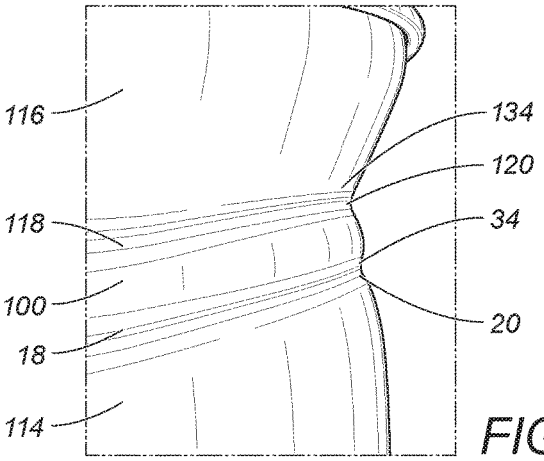
Figure 6:
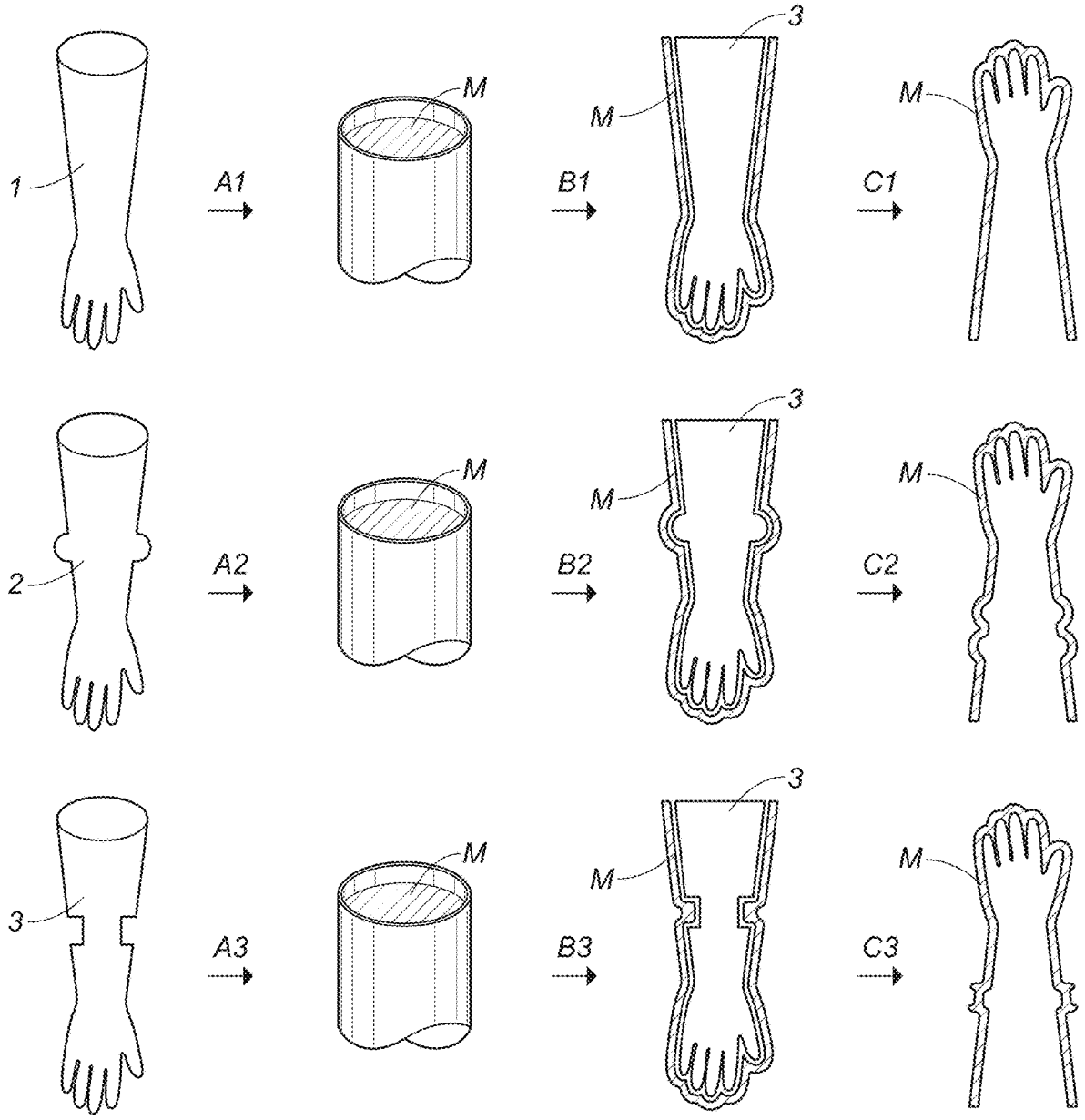
FIG. 6 (Prior Art)
FIG. 6 is a schematic illustration of the steps of the manufacturing process of the glove of the present invention and prior art gloves.
Figure 7A:
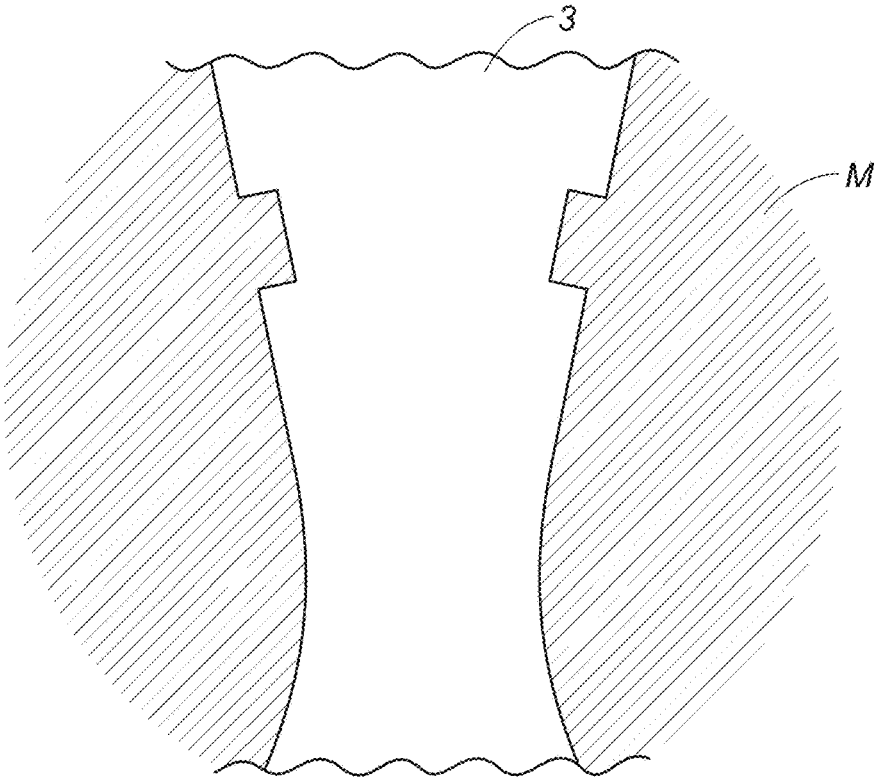
FIGS. 7A, 7B, and 7C are enlarged schematic illustrations of Steps A3, B3, and C3 of FIG. 6 for the glove of the present invention.
Figure 7B:
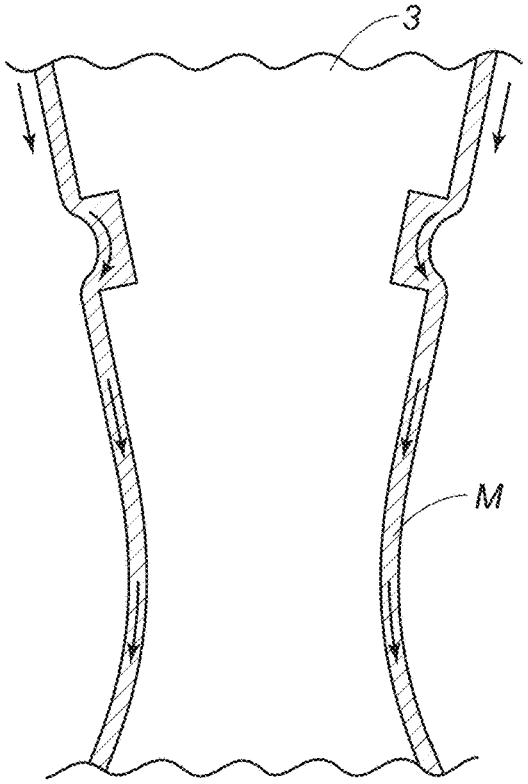
Figure 7C:
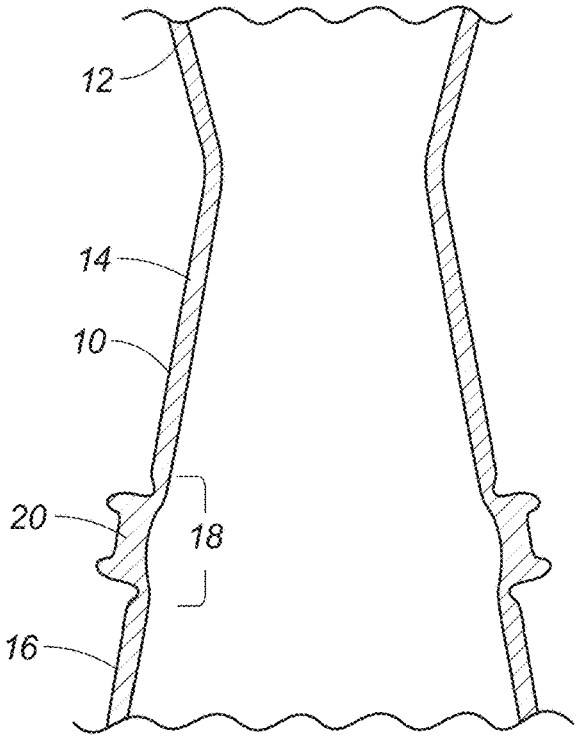

FIGS. 1-7C show embodiments of the glove 10, 110 of the present invention according to the manufacturing process of the glove 10. The recitation of the claims and descriptions are more precise and accurate than the "generally rectangular" and "generally orthogonal" terms of prior art references. FIG. 6 shows a schematic illustration of the manufacturing process for prior art gloves and the glove 10 of the present invention. Mold 1 forms the prior art of a regular glove without a cuff. Mold 2 forms the prior art glove with a cuff. Mold 2 has a protruding ridge to form an undulation. Mold 3 forms the glove 10 of the present invention. Mold 3 has a square cut grooved ring to form the components of the present invention. At Steps A1, A2, and A3, the molds 1, 2, 3 are dipped the glove material M, such as rubber or latex. At Steps B1, B2, and B3, the molds 1, 2, 3 are pulled from the glove material M, such that the rubber or latex drips down the molds 1, 2, 3. Undulations are formed by structures protruding from the mold 2. The thickness of rubber or latex is controlled and even. There is no pooling of rubber or latex, if the mold 1 or mold 2 is pulled from the rubber or latex at the proper speed. There is no pooling if the rubber or latex is allowed to drip from the mold 2 while curing in Step B2.

For Step B3 for the present invention, the rubber or latex pools in the cavity formed by the square cut grooved ring. The thickness of the rubber or latex is no longer uniform. There is pooling for a thicker thickness inside the square cut grooved ring and thinned thickness at the entrance and exit of the square cut grooved ring as the rubber or latex flows past the square cut grooved ring. There can be a concavity on the outer surface of the rubber or latex flows past the square cut grooved ring. The sharp angles and edge of the mold does form the same sharp angles and edges for V-shaped channels. The present invention now more accurately and precisely describes the components that were previously generally rectangular and generally orthogonal.

Steps C1, C2, and C3 all show the gloves turned right side out from the molds 1 2, 3. Step C1 shows the prior art glove without a cuff. Step C2 shows the prior art gloves with a cuff by undulations or attempts at bulges. Step C3 shows the glove 10 of the present invention. The material characteristics of the rubber or latex cannot maintain the sharpness of the square cut grooved ring of mold 3. Steps A3, B3, and C3 are present in enlarged schematic views as FIGS. 7A, 7B, and 7C.

Referring to FIGS. 1-7C, embodiments of the present invention include a glove 10, 110, with a hand portion 12, 112, a sleeve portion 14, 114, a cuff portion 16, 116, and a connection portion 18, 118. The hand portion 12, 112 covers the fingers and palm of the wearer and has cavities for the five digits. The palm side can be textured, as well as the fingertips, for improved gripping action. The sleeve portion 14, 114 is made integral to the hand portion 12, 112 and extends conically outward from the hand portion 12, 112. The sleeve portion 14, 114 is generally frustoconical and covers the wrist and forearm of the wearer. The cuff portion 16, 116 is made integral with the sleeve portion 14, 114 and extends conically outward from the sleeve portion 14, 114. The cuff portion 16, 116 is the end of the glove 10, 110 with the opening for insertion of the hand of the wearer. The cuff portion 16, 116 flares out as the generally conical shape of the sleeve portion 14, 114 spreads and the cuff portion 16, 116 spreads. Prior art cuff portions can have textured outer surfaces and reinforced support to maintain integrity of the glove. The cuff portions can also have different colors than the sleeve and hand portions. The typical problem with the cuff portion is the inability to prevent liquid from dripping from the hand portion, along the sleeve portion, and pass the cuff portion to the arm of the wearer. Liquids, like water, run down the glove and wet the wearer. The present invention folds the cuff portion over the sleeve portion to form a barrier. Liquid will no longer be able to run down the glove and onto the wearer. The cuff portion in the folded configuration is locked and supported so as to prevent the liquid or water from contacting the wearer.

In embodiments of the present invention of FIGS. 1-7C, there is a connection portion 18, 118 between the cuff portion 16, 116 with a cuff thickness 16A and the sleeve portion 14, 114 with sleeve thickness 14A. The cuff thickness 16A and sleeve thickness 14A are dimensions determined when the glove 10 is manufactured. There is an extended configuration with the hand portion 12, the sleeve portion 14, and the 16 cuff portion in linear alignment, and there is a folded configuration with the hand portion 12 and the sleeve portion 14 in linear alignment and the cuff portion 16 bent over the sleeve portion 14 toward the hand portion 12. The connection portion 18, 118 is the location or pivot of the bend so that the cuff portion 16, 116 inverts to be positioned over the sleeve portion 14, 114. Liquid will flow down the hand portion 14, 114 and the sleeve portion 16, 116 until turning at the connection portion 18, 118 to encounter the inverted cuff portion 16, 116, which stops flow from the arm of the wearer.

FIGS. 1, 2, 6, and 7A show embodiments of the connection portion 18 between the cuff portion 16 and the sleeve portion 14. The connection portion comprises an annular band 20, and the cuff portion 16 folds over the sleeve portion 14 at the connection portion 18. The annular band 20 comprises a first ring 22 with a first thickness 22A being adjacent to the sleeve portion 14, a second ring 24 with a second thickness 24A, and a protruding ring 26. The first thickness 22A is less than the sleeve thickness 14A, and the second thickness 24A is less than the cuff thickness 16A. The first ring 22 and the second ring 24 correspond to the thinnest thicknesses of the connection portion 18, which are analogous to the bottom of the V-shape in the V-shaped channels of the prior art. The protruding ring 26 comprises a first bulged rim 28 with a first bulged thickness 28A, a second bulged rim 30 with a second bulged thickness 30A, and a band portion 32 with a band thickness 32A. In some embodiments, the band portion 32 has a concave curvature. Formed as the glove material M drips inward in Step C2 of FIG. 6. The curvature faces interior of the glove 10. The first bulged rim 28 and the second bulged rim 30 are formed by pooling of the glove material in the square cut grooved ring in Step C2 of FIG. 6. The first bulged rim 28 and the second bulged rim 30 are defined by different thickness from the adjacent components. This identification of the components as first bulged rim 28 and second bulged rim 30 and band portion 32 are more accurate and precise, according to the reality of manufacturing the glove 10. The first bulged thickness 28A is greater than the sleeve thickness 14A and greater than the band thickness 32A. The second bulged thickness 30A is greater than the cuff thickness 16A and greater than the band thickness 32A. The band thickness 32A is greater than the sleeve thickness 14A and greater than the cuff thickness 16A. The sharp angles and edges of the prior art are replaced with components with relationships defined by relative thicknesses.

These physical relationships allow the components to lock and support the folded configuration of the cuff portion 16. Locking refers resisting the unfolding for the cuff portion 16 from the folded configuration to the extended configuration. Pulling on the cuff portion in the right direction will unfold the folded configuration, but locking increases the force needed to pull on the cuff portion 16 to unfold. Locking prevents the cuff portion 16 from flopping unfolded with little effort. Supporting refers to making an increase in resisting the unfolding. Besides increasing the force needed to pull on the cuff portion 16 to unfold, supporting reduces the weight of the cuff portion 16 exerted to unfold the cuff portion 16. The full weight of the cuff portion 16 can no longer be used as part of a passive force on the cuff portion 16 to unfold from the folded configuration. The flopping of the cuff portion 16 could previously unfold the cuff portion 16, since the full weight of the cuff portion 16 could flop in the right direction to unfold the folded configuration. In the present invention, there is a second hinged relationship that prevents that full weight of the cuff portion 16 to flop and unfold at the first hinged relationship determining the folded configuration.

Figure 1:
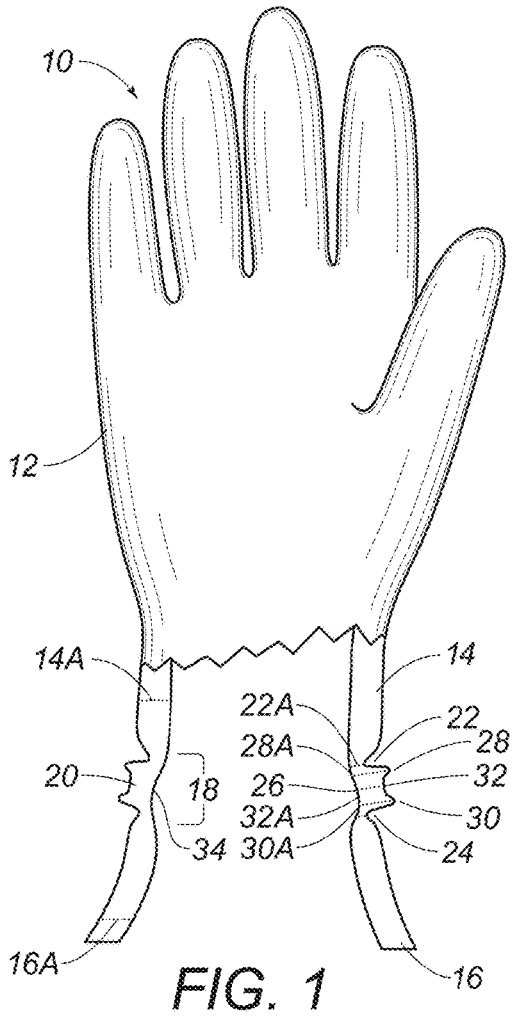
FIG. 1 is a schematic view of an embodiment of the glove with a cuff portion according to the present invention, showing the extended configuration.
Figure 2:
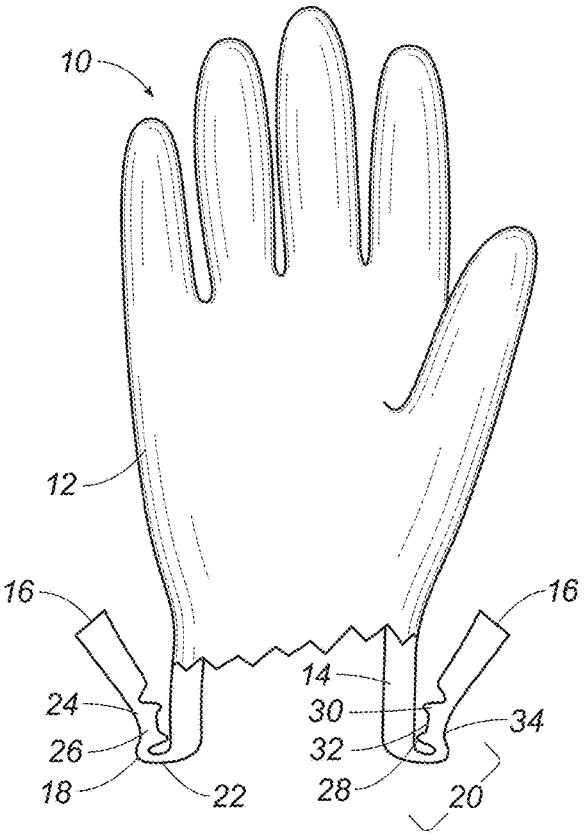
FIG. 2 is a schematic view of the embodiment of the glove with a cuff portion according to the present invention with the annular band, showing the folded configuration at the first ring.

FIG. 2 shows the second ring 24 being adjacent the cuff portion 16. The connection portion 18 is in a first hinged relationship with the sleeve portion 14 at the first ring 22, such that the protruding ring 26 is folded over the sleeve portion 14, when the cuff portion 16 is in the folded configuration. FIG. 2 shows that the first bulged rim 28 and the second bulged rim 30 contact the sleeve portion 14 so as to lock folded configuration. The protruding ring 26 also faces the sleeve portion 14 so as to lock the folded configuration. FIG. 2 also shows the connection portion 18 in a second hinged relationship with the cuff portion 16 at the second ring 24 so as to support folded configuration. By locking, the strength of the first hinged relationship is greater than a force to actuate the cuff portion 16 from the folded configuration to the extended configuration. The cuff portion 16 can resist unfolding. By supporting, the strength of the first hinged relationship is still strong, but the force to actuate the cuff portion from the folded configuration to the extended configuration is different. With the second hinged relationship at the second ring 24, the full weight of the cuff portion is no longer a passive force exerted on the first hinged relationship to unfold. There is a reduced weight of the cuff portion 16 exerted against the first hinged relationship. The cuff portion 16 is no longer flopping in different directions for and against the first hinged relationship with the full weight. The second hinged relationship reduces the full weight of the cuff portion 16 exerted against the strength of the first hinged relationship in both the directions for and against the unfolding. There is no problem when the cuff portion 16 flops to keep the folded configuration, and now there is less weight when the cuff portion 16 flops against the folded configuration.

FIGS. 5A, 5B, and 5C are photographs of an alternative embodiment of the glove 110 formed by the conventional manufacturing process. FIG. 5A shows the glove 110 with light behind the glove from the interior. The first ring 22, the second ring 24, and the protruding ring 26 are visible. The light reveals the thinnest thickness of the glove as the first ring 22 and the second ring 24 indicated by more light passing through the glove material M. For the embodiment with an additional annular band 120 of FIGS. 3-4, FIG. 5A also shows the thinnest thickness of the glove as the additional first ring 122 and the additional second ring 124 by light passing through the glove material M. The bright rings are the first ring 22, second ring 24, additional first ring 122 and the additional second ring 124. FIG. 5B shows the glove 110 from the exterior with light behind the exterior. Again, the first ring 22, the second ring 24, and the protruding ring 26 of the annular band 20 are visible, along with the additional first ring 122, the additional second ring 124, and the additional protruding ring 126 of the additional annular band 120. FIG. 5B also shows the first bulged rim 28, the second bulged rim 30 and the band portion 32 of the protruding ring 26 AND the additional first bulged rim 128, the additional second bulged rim 130 and the additional band portion 132 of the additional protruding ring 126. The first bulged rim 28, the second bulged rime 30, the additional first bulged rim 128, and the additional second bulged rim 130 are indicated by the dark bands. Less light passes through because the glove material M is thicker, and the exterior view shows the bulge or protrusion from the surface of the glove 110. Additionally, less light passing through the band portion 32 and the additional band portion 132 shows as darker areas relative to the sleeve portion 114 and the cuff portion 116 for the embodiments with and without the additional annular band 120. FIG. 5C is a photo of the inside-out glove 110 showing the concave curvatures 34, 134 of the band portion 32 and additional band portion 132. The pooling behavior of the glove material M is not recited for the invention more accurately and precisely. Even with the concave curvature, the band thickness 32 and additional band thickness 132 are greater than the sleeve thickness 114A and the cuff thickness 116A.

Figure 3:
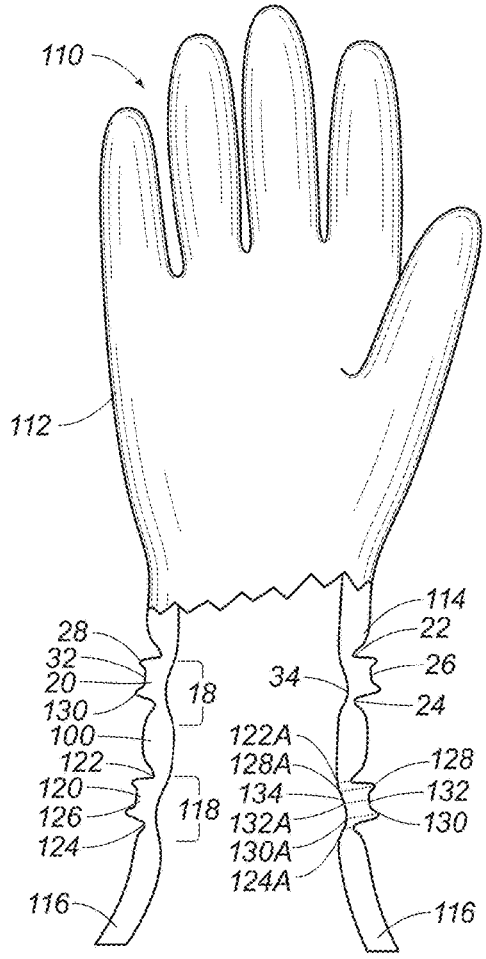
FIG. 3 is a schematic view of an alternative embodiment of the glove with a cuff portion according to the present invention with the annular band and the additional annular band, showing the extended configuration.
Figure 4A:
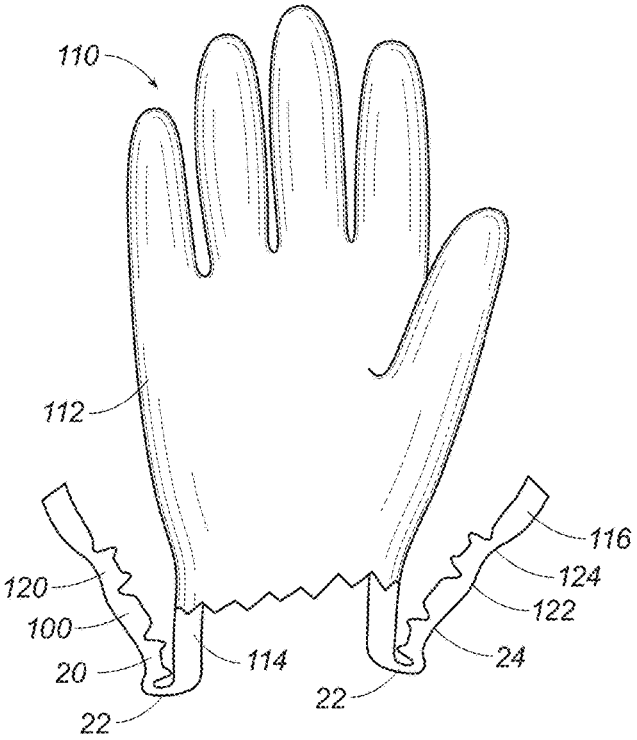
FIG. 4A is a schematic view of the alternative embodiment of the glove with a cuff portion according to the present invention, showing the folded configuration at the first ring.
Figure 4B:
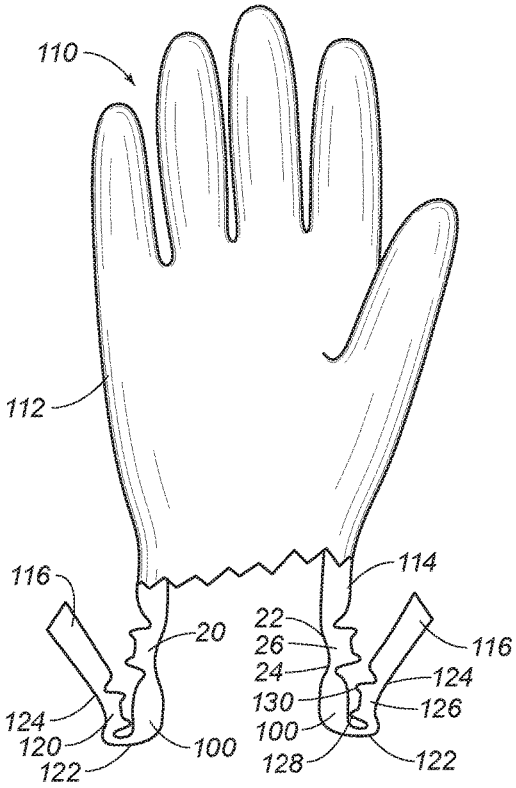
FIG. 4B is a schematic view of the alternative embodiment of the glove with a cuff portion according to the present invention, showing the folded configuration at the additional first ring.

As shown in FIGS. 5A, 5B, and 5C, the alternative embodiment of the present invention includes a glove 110 with an additional annular band 120. FIGS. 3, 4A, and 4B also show this alternative embodiment. The connection portion 118 further comprises an additional annular band 120, and a transitional portion 100 between the annular band 20 and the additional annular band 120. The transitional portion 110 has a transitional thickness 100A similar to the sleeve thickness 114A and cuff thickness 116A. The additional annular band 120 comprises an additional first ring 122 with an additional first thickness 122A, an additional second ring 124 with an additional second thickness 124A, and an additional protruding ring 126 between the additional first ring 122 and the additional second ring 124. The additional protruding ring 126 comprises an additional first bulged rim 128 with an additional first bulged thickness 128A, an additional second bulged rim 130 with an additional second bulged thickness 130A, and an additional band portion 132 with an additional band thickness 132A. The additional first thickness 122A is less than the transitional thickness 100A, and the additional second thickness 124A is less than the cuff thickness 116A. The additional first bulged thickness 128A is greater than the transitional thickness 100A and greater than the additional band thickness 132A. The additional second bulged thickness 130A is greater than the cuff thickness 116A and greater than the additional band thickness 132A. The additional band thickness 132A is greater than the transitional thickness 100A and greater than the cuff thickness 116A. These relationships of the components by thickness are also shown in FIGS. 5A, 5B, and 5C.

The embodiment of FIGS. 3, 4A and 4B with the additional annular band 120 is not just a repetition of component. A new component is created in the transitional portion 100, and the relationship to this new component by thickness and hinged relationship are not just repetition for the embodiment of FIGS. 1-2.

In particular, the relationships of FIG. 2 are intact. FIG. 4A still shows the second ring 24 being adjacent the cuff portion 116 and the connection portion 118 in a first hinged relationship with the sleeve portion 114 at the first ring 22, such that the protruding ring 26 is folded over the sleeve portion 114 as in FIG. 2. The first bulged rim 28 and the second bulged rim 30 contact the sleeve portion 114 so as to lock folded configuration in both FIG. 2 and FIG. 4A. The protruding ring 26 also faces the sleeve portion 114 so as to lock the folded configuration in both FIG. 2 and FIG. 4A. FIG. 4A now shows the connection portion 118 in a second hinged relationship with the cuff portion 116 at the second ring 24, an additional first hinged relationship with the cuff portion 116 at the additional first ring 122, and an additional second hinged relationship with the cuff portion 116 at the additional second ring 124. These three other hinged relationships now also support folded configuration. By the same locking, the strength of the first hinged relationship is greater than a force to actuate the cuff portion 116 from the folded configuration to the extended configuration. The cuff portion 116 can resist unfolding. By supporting in the alternative embodiment, the strength of the first hinged relationship is still strong, but the force to actuate the cuff portion from the folded configuration to the extended configuration is even more different. With the second hinged relationship at the second ring 24, the additional first hinged relationship at the additional first right 122, and the additional second hinged relationship at the additional second ring 124, the full weight of the cuff portion even less of a passive force exerted on the first hinged relationship to unfold than the embodiment of FIG. 2. There is a reduced weight of the cuff portion 116 exerted against the first hinged relationship. The cuff portion 116 is now very floppy at the three other hinged relationships. The cuff portion 116 is flopping less in different directions for and against the first hinged relationship with the full weight because the full weight is less coordinated to be flopped in any one direction due to the three hinged relationships. The three other hinged relationships reduce the full weight of the cuff portion 116 exerted against the strength of the first hinged relationship in both the directions for and against the unfolding. There is no problem when the cuff portion 116 flops to keep the folded configuration, which may be rare in this embodiment anyway, and now there is less weight when the cuff portion 116 flops against the folded configuration.

FIG. 4B shows a variation of the folded configuration of glove 110 in FIG. 3. The additional second ring 124 remains adjacent to the cuff portion 116. In the folded configuration of FIG. 4B, the connection portion 118 is in the additional first hinged relationship with the sleeve portion 116 at the additional first ring 122, instead of the first ring 22. The additional protruding ring 126 is folded over the transitional portion 100, when the cuff portion 116 is in the folded configuration. The additional protruding ring 126 faces the transitional portion 100 to lock the folded configuration. Now, the connection portion 118 is in the additional second hinged relationship with the cuff portion 116 at the additional second ring 124. This additional second hinged relationship now supports the folded configuration. The first ring 22 and the second 24 are no longer related to the folded configuration for glove 110. The strength of the additional first hinged relationship is even greater than the force to actuate the cuff portion 116 from the folded configuration to the extended configuration.

Embodiments of the present invention provide a glove with a locked and supported cuff. The components of the glove formed according to the manufacturing process are identified and described with more accuracy and precision. The sharp angles and edges are no longer relied upon to define the invention. The invention is now compatible with the conventional knowledge of manufacturing a glove with a dipping process without flow disruption of the glove material. The pooling and thinning of the glove material according to the mold used for the present invention is now stated more accurately. The connection portion now recites an annular band, and the individual parts forming the annular band are clearly identified as a first ring, a second ring, and a protruding ring. The parts performing the locking are recited as the protruding ring with the first bulged rim, the second bulged rim, and the band portion. The folded configuration of the cuff portion is recited relative to the first ring of the annular band and the alternative embodiment of the additional first ring of the additional annular band. The positions of the components for locking the folded configuration and for supporting the folded configuration are now recited according to the named components.

The foregoing disclosure and description of the invention is illustrative and explanatory thereof. Various changes in the details of the illustrated structures, construction and method can be made without departing from the true spirit of the invention.

I claim:

1. A glove comprising:

a hand portion;

a sleeve portion being made integral to said hand portion, extending outward from said hand portion, and having a sleeve thickness;

a cuff portion being made integral with said sleeve portion, extending conically outward from said sleeve portion, and having a cuff thickness, wherein said cuff portion has an extended configuration with said hand portion, said sleeve portion, and said cuff portion in linear alignment, and wherein said cuff portion has a folded configuration with said hand portion and said sleeve portion in linear alignment and said cuff portion folded over said sleeve portion toward said hand portion; and a connection portion between said cuff portion and said sleeve portion, said connection portion being comprised of an annular band, said cuff portion folding over said sleeve portion in the folded configuration at said connection portion, wherein said annular band comprises:

a first ring having a first thickness and being adjacent to said sleeve portion;

a second ring having a second thickness, said first thickness being less than said sleeve thickness, said second thickness being less than said cuff thickness; and a protruding ring being between said first ring and said second ring, and wherein said protruding ring comprises:

a first bulged rim having a first bulged thickness;

a second bulged rim having a second bulged thickness; and a band portion having a band thickness and being between said first bulged rim and said second bulged rim, wherein said first bulged thickness is greater than said sleeve thickness and greater than said band thickness, said second bulged thickness being greater than said cuff thickness and greater than said band thickness.

2. The glove according to claim 1, said band thickness being greater than said sleeve thickness and greater than said cuff thickness.

3. The glove according to claim 2, said second ring being adjacent said cuff portion, wherein said connection portion is in a first hinged relationship with said sleeve portion at said first ring, and wherein said protruding ring is folded over said sleeve portion, when said cuff portion is in said folded configuration.

4. The glove according to 3, wherein said first bulged rim and said second bulged rim contact said sleeve portion, when said cuff portion is in the folded configuration, so as to lock the folded configuration.

5. The glove according to claim 3, wherein said protruding ring faces said sleeve portion, when said cuff portion is in the folded configuration, so as to lock the folded configuration.

6. The glove according to claim 3, wherein said connection portion is in a second hinged relationship with said cuff portion at said second ring so as to support the folded configuration.

7. The glove according to claim 3, wherein strength of said first hinged relationship is greater than a force to actuate said cuff portion from the folded configuration to the extended configuration.

8. The glove according to claim 7, wherein said connection portion is in a second hinged relationship with said cuff portion at said second ring.

9. The glove according to claim 1, wherein said protruding ring has a concave curvature.

* * * * *